US005457873A

United States Patent [19]

Cattaneo

[11] Patent Number: 5,457,873

[45] Date of Patent: Oct. 17, 1995

[54] METHOD FOR MOUNTING AN ELECTRICAL COIL ON A MAGNETIC CIRCUIT WITH AN AIR GAP

[75] Inventor: Pierre Cattaneo, Collonges-s/Sal`eve, France

[73] Assignee: Liaisons Electroniques Mecaniques LEM S.A., Geneva, Switzerland

[21] Appl. No.: 119,089

[22] PCT Filed: Jan. 20, 1993

[86] PCT No.: PCT/CH93/00010

§ 371 Date: Sep. 16, 1993

§ 102(e) Date: Sep. 16, 1993

[87] PCT Pub. No.: WO93/14509

PCT Pub. Date: Jul. 22, 1993

[30] Foreign Application Priority Data

Jan. 21, 1992 [CH] Switzerland ..... 00163/92

[51] Int. Cl.[6] ..... H01F 41/02

[52] U.S. Cl. ..... 29/606; 29/609; 336/180; 336/184; 336/185; 336/221

[58] Field of Search ..... 29/606, 609; 336/180, 336/184, 185, 221, 234

[56] References Cited

U.S. PATENT DOCUMENTS

| | | | |
|---|---|---|---|
| 1,401,493 | 12/1921 | Replogle . | |
| 3,034,203 | 5/1962 | Vienneau | 29/606 |
| 4,267,719 | 5/1981 | Walker | 29/596 |
| 4,790,064 | 12/1988 | Ballard | 29/606 |

FOREIGN PATENT DOCUMENTS

| | | |
|---|---|---|
| 2154806 | 9/1985 | United Kingdom . |

*Primary Examiner*—Carl E. Hall

*Attorney, Agent, or Firm*—Clifford W. Browning; Woodard, Emhardt, Naughton Moriarty & McNett

[57] ABSTRACT

Plane sheets which have the same shape as the magnetic circuit and are relatively movable along their contact surface are arranged in a stack. The stack is grasped and part of the circuit is bent out of alignment with the plane of the sheets to enable a coil to be placed on a portion of the circuit which is next to the air gap, whereafter said part is bent back into alignment with said sheets.

3 Claims, 2 Drawing Sheets

METHOD FOR MOUNTING AN ELECTRICAL COIL ON A MAGNETIC CIRCUIT WITH AN AIR GAP

The present invention is concerned with a method for mounting an electric coil on a magnetic circuit with an air gap of a current sensor, this circuit being formed by a stack of metal sheets of a magnetically permeable material.

Present day current sensors, the magnetic circuit of which has a single air gap, require nevertheless a magnetic circuit formed of two separate pieces or of stacks of two groups of pieces of metal sheet to allow the mounting of a coil on one branch of the magnetic circuit. Such a structure and the resulting assembling process are expensive and render the automatic assembling installations relatively complicated.

The invention is aimed at providing a method for mounting at least one coil on a magnetic circuit which is substantially simpler and cheaper, in particular for automated assembling in mass production.

To this end, the method of the invention is characterized in that metal sheets are stacked, which all have the general shape of the magnetic circuit and which are slidable in their plane each one relatively to the others, in that this stack is held firmly and at least one part of the circuit close to the air gap is deformed relatively to the plane of the metal sheets, in such a manner as to allow the placement of the coil on a portion close to the air gap, and in that the deformed parts of the circuit are brought back into the plane of the metal sheets after the placement of the coil.

In a preferred embodiment of this method, at least the portion of the circuit on which the coil will be placed and/or at least one portion of the circuit at the opposite of the air gap are clamped during the deformation of at least one portion of the circuit. Preferably, the deformation of the metal sheets is spread over the major part of the circuit which is not clamped.

According to one embodiment of this method, the metal sheets are deformed and then brought back into their plane by means of at least one pusher. This pusher can include a part which is at least temporarily clamped to the coil.

The invention is concerned in particular with the application of the present method to a magnetic circuit having an air gap within a rectilinear part of the circuit and to a coil of a length comprised between those of said branches and, in this case, the coil is placed in its final position in which the air gap is located within the coil, once the circuit is brought back into the plane of the metal sheets.

The invention is also concerned with a current sensor made by using the method according to claim 1.

Such a sensor can advantageously have a magnetic circuit which includes a rectilinear base branch and two rectilinear branches formed inclined at an acute angle with respect to the base branch, the first ends of the inclined branches being connected to the base branch and the second ends of the inclined branches being arranged to form the air gap of the magnetic circuit.

In this case, one can advantageously place on the circuit two coils, namely one coil on each one of the inclined branches, and this without increasing the deformation of the magnetic circuit for placing the second coil. Further, in this manner, a structure is obtained which exhibits an optimal ratio of the circuit length to the volume of the windings of the coil with which the circuit is coupled. The acute angle is preferably equal substantially to 45°. The air gap can be made substantially perpendicular to the base branch or parallel to one of the inclined branches.

Other features and advantages of the invention will become apparent from the following description of preferred embodiments, given by way of example and illustrated by the appended drawing, in which.

Figure 1:
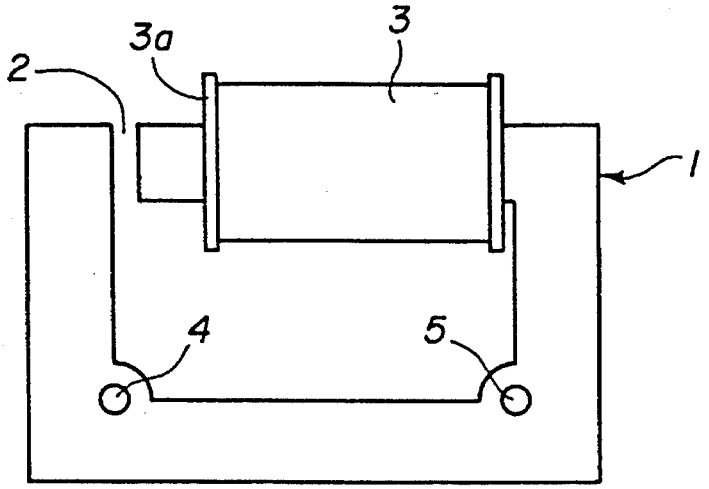
FIG. 1 shows a magnetic circuit with a coil mounted according to the invention.

FIG. 1 is a lateral view of a magnetic circuit 1 having an air gap 2 and carrying on a branch adjacent to the air gap, a coil 3 wound on a coil body 3*a*. The circuit 1 is formed as a stack of flat metal sheets, as is apparent from the top view of FIG. 2. All the individual metal sheets have the shape of the circuit shown in FIG. 1. They do not adhere together, but can move each one relatively to the others along their surfaces of contact. They can however be maintained clamped together by means of rivets inserted into the through holes 4 an 5 apparent in FIG. 1. After the assembling of the coil, these metal sheets will also be held by the coil body 3*a*.

Figure 2:
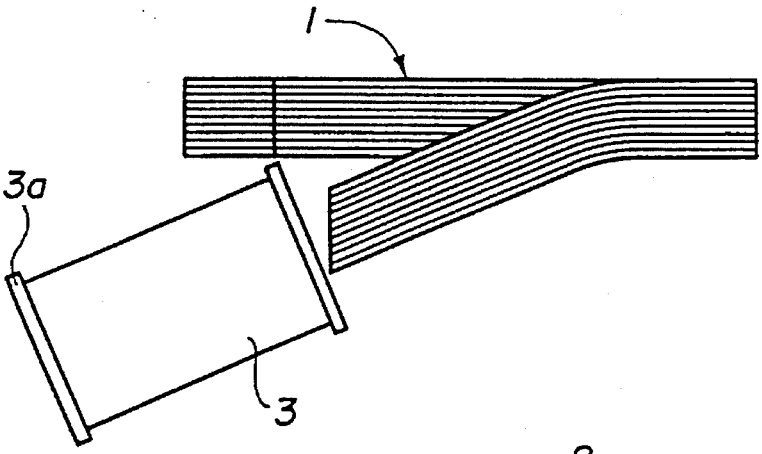
FIG. 2 illustrates the partial bending of the metal sheets and the positioning of the coil in the case of the circuit of FIG. 1.

FIG. 2 illustrates the bending, as it can be carried out in the present method, for deforming the upper branch intended for carrying the coil, out of the plane of the metal sheets clamped together and held in place at their lower part. The angle of bending depends on the transverse dimension of the coil, namely on the radius or half width of the flanges of the coil body 3*a*, and on the half thickness of the stack of metal sheets, so as to allow slipping this coil on the bent branch of the circuit. Once the coil in position, the branch is bent to bring it back into the plane of the portions of the circuit which had not been deformed.

Figure 3:
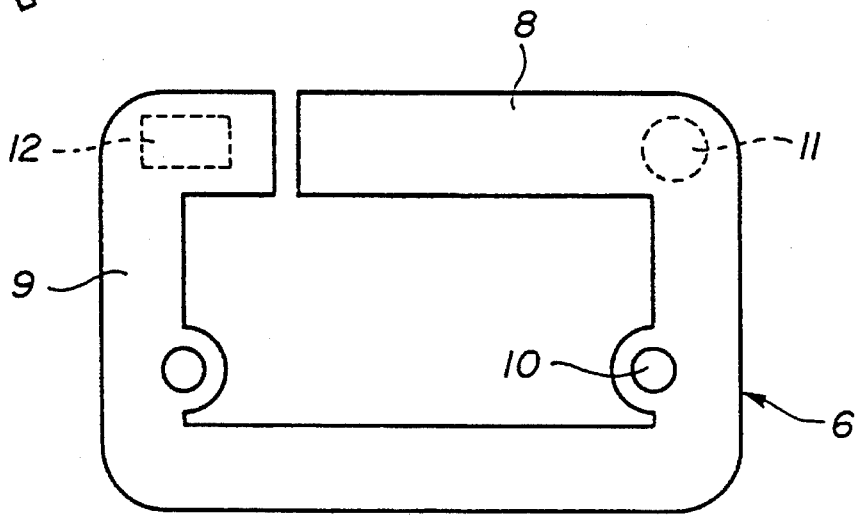
FIG. 3 shows another version of the shape of the metal sheets of a magnetic circuit.
Figure 4:
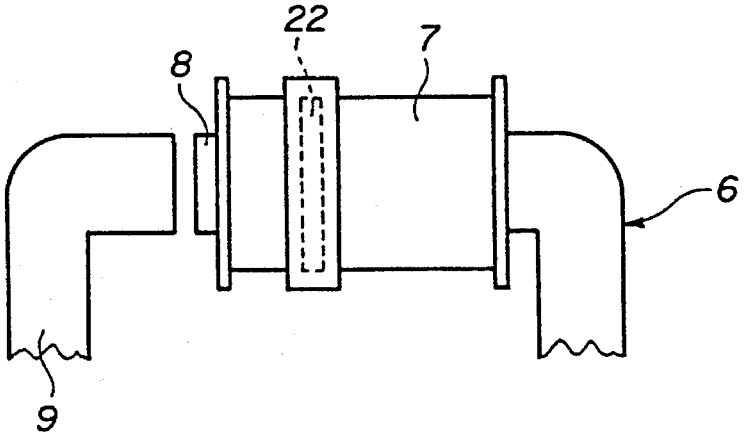
FIGS. 4 and 5 show a magnetic circuit using the metal sheets of FIG. 3 with a coil placed respectively in an intermediate position and in its final position.
Figure 5:
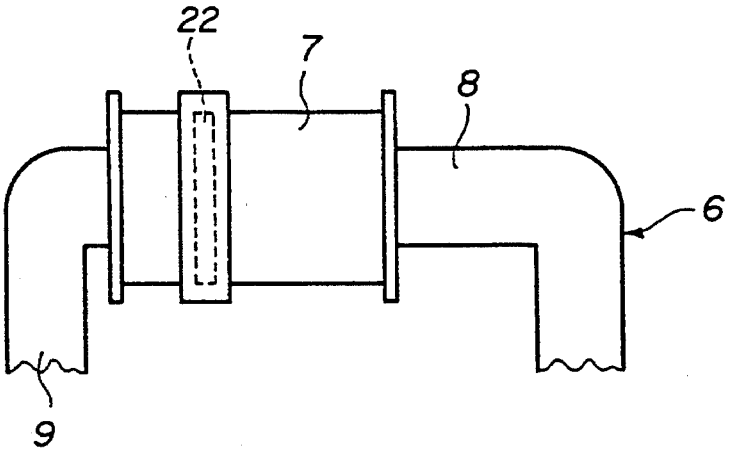

FIGS. 3 to 5 show another embodiment of the circuit 6 which is substantially rectangular and in which the air gap is located inwards on a longer side of the circuit. FIG. 3 is a lateral view of this circuit, which is otherwise similar to that of FIG. 1. FIG. 4 shows this circuit with a coil 7 placed on one of the branches 8 forming the air gap, this coil being slipped on this branch for example in a manner similar to that illustrated in FIG. 2. In an alternative version, which is particularly advantageous in the case of an automatic assembling, it is not the branch 8 carrying the coil which is deformed out of the plane of the metal sheets for allowing the passage of the coil, but the remainder of the circuit, with the branch 8 being held straight in this case. The metal sheets can be clamped together during bending by a single rivet 10 or further by a tong-shaped member, which clamps the metal sheets in an area 11, in such a manner as to allow the deformation to spread over the remainder of the circuit. In this respect, one will note the shape of the circuit around the reinforcement for the rivet hole 10, which reduces the rigidity of the circuit at this place by comparison with the example of FIG. 1.

FIG. 4 shows that coil 7 can include a housing 22 for a magnetic field detector which will be positioned in the air gap of the circuit. In this embodiment, the coil is moved on the circuit after the latter has been reinstated in its flat shape, so that this housing be positioned at the location of the air gap, the latter being thus located inside the coil, which is advantageous for the performance of the current sensor using this circuit.

In order to carry out the deformation of the circuit, one uses preferably a pusher type member, the action of which can be exerted for example in a position 12 on the stack of metal sheets, and this in such a manner that the individual metal sheets be capable of moving each one relatively to the others during the deformation. Depending on the application of the force of deformation and on the portion or portions which are clamped, the deformation will be of the nature of a bending or of a more complex deformation involving a torsion of at least one branch of the circuit.

According to one embodiment of the present method, the pusher can include a part clamped on the coil, at least during the action of deformation or of bending, so as to use the motion of the coil bringing the same opposite the end of the branch 8, to push aside the end of the branch 9.

Figure 6:
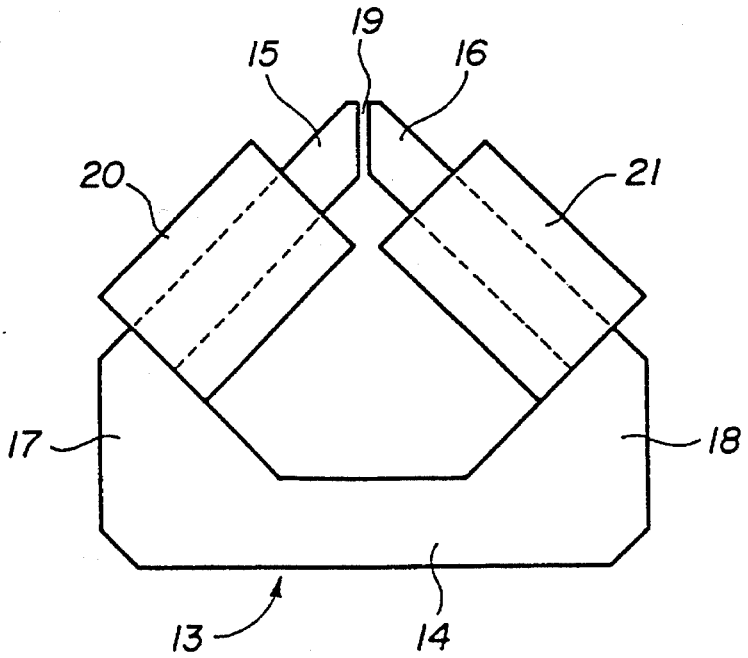
FIG. 6 shows another embodiment of the magnetic circuit carrying two coils mounted according to the invention.

FIG. 6 shows a magnetic circuit 13 which includes a rectilinear base branch 14 and two rectilinear branches 15, 16 inclined with respect to this base branch. One of the ends of each one of the branches 15, 16 is connected to the base branch via parts such as 17, 18, the other free ends forming an air gap 19. Coils 20, 21 are placed on the respective branches 15, 16, these coils being depicted schematically to illustrate their bulk in relation to that of circuit 14. On can see from this illustration that the maximum values of the length and of the transverse dimension of these coils which allow their positioning by pulling away from each other the free ends of the branches 15, 16 perpendicularly to the plane of the metal sheets, are dependent upon each other. One can also deduce from this illustration that an angle of slant of 45° of the branches 15, 16 relative to the base branch 14 provides an optimum when it is sought to maximize the volume of the coil and to minimize the length of the magnetic circuit. The structure, the principle of which is illustrated in FIG. 6, is also quite advantageous from the standpoint of the deformation produced when positioning the coils, this deformation leading to relatively low stresses in the metal sheets.

The air gap can be provided as shown in FIG. 6 perpendicularly to the branch 14 or it can be formed between the front face of one of the inclined branches and the side face of the other branch, so as to run parallel to the latter one.

The present method is applicable more particularly to the manufacture of current sensors of the type described in the Swiss Patent N°677 034, the contents of which are to be considered as forming an integral part of the present description.

I claim:

1. A method for mounting at least one electric coil on a magnetic circuit of a current sensor, said circuit being formed by a stack of metal sheets of a magnetically permeable material and comprising first and second aligned rectilinear branches separated by an air gap, said metal sheets all having the general shape of the magnetic circuit and being capable of sliding each one relative to the others in their plane, said electric coil comprising a winding made in two parts to be placed on either side of said air gap, said method comprising the steps of clamping a first portion of said stack, bending at least a second portion of said stack close to said air gap relative to the plane of said metal sheets, placing said coil on said first rectilinear branch of said magnetic circuit, bringing said bent portion or portions of the circuit back into the plane of said metal sheets and moving said coil in the direction of said second rectilinear branch until said two parts of the winding are positioned on either side of said air gap.

2. A method according to claim 1, wherein said metal sheets are bent and then brought back into their plane by means of at least one pusher.

3. A method according to claim 2, wherein said pusher includes one part which is at least temporarily fixed to said coil.

* * * * *